US007636951B2

(12) United States Patent
Morrow et al.

(10) Patent No.: US 7,636,951 B2
(45) Date of Patent: Dec. 29, 2009

(54) PROTECTIVE SPORTS GLOVE WITH FLOATING CUFF PORTION

(75) Inventors: David Morrow, Metamora, MI (US); Matthew Winningham, Birmingham, MI (US)

(73) Assignee: Warrior Sports, Inc., Warren, MI (US)

( * ) Notice: Subject to any disclaimer, the term of this patent is extended or adjusted under 35 U.S.C. 154(b) by 515 days.

(21) Appl. No.: 10/904,445

(22) Filed: Nov. 10, 2004

(65) Prior Publication Data

US 2005/0114984 A1 Jun. 2, 2005

Related U.S. Application Data

(60) Provisional application No. 60/518,772, filed on Nov. 10, 2003.

(51) Int. Cl.
*A41D 19/00* (2006.01)

(52) U.S. Cl. ..... 2/161.1; 2/16

(58) Field of Classification Search ..... 2/161.1, 2/161.4, 159, 20, 16, 161.2, 161.3, 161.6, 2/161.8, 167, 169
See application file for complete search history.

(56) References Cited

U.S. PATENT DOCUMENTS

| | | | | |
|---|---|---|---|---|
| 2,293,347 | A | 8/1942 | Lindfelt | |
| 2,708,753 | A | 5/1955 | Kennedy | |
| 2,831,196 | A | 4/1958 | Scheiber | |
| 3,037,209 | A | 6/1962 | Applegate, Jr., et al | |
| 3,387,306 | A | 6/1968 | Korey | |
| 4,094,014 | A | 6/1978 | Schroeder | |
| 4,355,424 | A | 10/1982 | McCoy, Jr. | |
| 4,411,024 | A | 10/1983 | Hayes | |
| 4,484,359 | A | 11/1984 | Tirinen | |
| 4,497,073 | A * | 2/1985 | Deutsch | 2/20 |
| 4,519,097 | A | 5/1985 | Chappell, Jr. et al. | |
| 4,662,006 | A | 5/1987 | Ross, Jr. | |
| 4,677,698 | A | 7/1987 | Angas | |
| 4,815,147 | A | 3/1989 | Gazzano et al. | |
| 4,894,866 | A | 1/1990 | Walker | |
| 4,894,868 | A | 1/1990 | Christopher | |

(Continued)

FOREIGN PATENT DOCUMENTS

| | | |
|---|---|---|
| DE | 2842720 | 4/1980 |

(Continued)

OTHER PUBLICATIONS

Debeer, The Response, "Response" Glove, 2004.

(Continued)

*Primary Examiner*—Katherine Moran
*Assistant Examiner*—Richale L Quinn
(74) *Attorney, Agent, or Firm*—Warner Norcross & Judd LLP

(57) ABSTRACT

A protective sports glove includes a free-floating subcuff for increased protection of a wearer's forearm and wrist. The glove also includes die cuts in the back portion that are configured to provide increased and more realistic flexibility. The glove also has increased ventilation for a wearer's hand in the form of mesh areas located within the palm portion and within die cuts formed in the back portion of the glove The protective sports glove further includes a multiple piece cuff for increased flexibility and a ventilated liner that provides a secure fit during play.

40 Claims, 8 Drawing Sheets

U.S. PATENT DOCUMENTS

| | | | | |
|---|---|---|---|---|
| 4,930,162 | A | 6/1990 | Cote | |
| 4,947,486 | A | 8/1990 | Hsuih | |
| 4,984,300 | A | 1/1991 | Cho | |
| 5,237,703 | A | 8/1993 | Brine et al. | |
| 5,329,639 | A | 7/1994 | Aoki | |
| 5,390,372 | A | 2/1995 | Hashimoto et al. | |
| 5,459,883 | A | 10/1995 | Garceau-Verbeck | |
| 5,488,739 | A * | 2/1996 | Cardinal | 2/161.1 |
| 5,511,243 | A * | 4/1996 | Hall et al. | 2/16 |
| 5,548,844 | A | 8/1996 | Ceresia | |
| 5,745,916 | A * | 5/1998 | Linner | 2/16 |
| 5,781,929 | A | 7/1998 | Shikatani | |
| 5,787,506 | A | 8/1998 | Wilder et al. | |
| 5,946,720 | A | 9/1999 | Sauriol | |
| 5,974,588 | A | 11/1999 | Furman | |
| 5,983,396 | A * | 11/1999 | Morrow et al. | 2/161.1 |
| 6,085,354 | A * | 7/2000 | Wilder et al. | 2/161.1 |
| 6,122,769 | A * | 9/2000 | Wilder et al. | 2/16 |
| 6,154,882 | A | 12/2000 | Ullman et al. | |
| 6,209,137 | B1 | 4/2001 | Wallick | |
| 6,233,744 | B1 | 5/2001 | McDuff | |
| D446,888 | S * | 8/2001 | Morrow | D29/113 |
| 6,389,601 | B2 | 5/2002 | Kleinert | |
| 6,405,380 | B1 | 6/2002 | Kuroda et al. | |
| D462,146 | S * | 8/2002 | Aoki | D29/113 |
| 6,453,474 | B2 | 9/2002 | Kleinert | |
| 6,526,592 | B1 | 3/2003 | Best | |
| 6,543,057 | B2 * | 4/2003 | Beland et al. | 2/161.1 |
| 6,550,069 | B1 * | 4/2003 | Morrow | 2/161.1 |
| 6,625,815 | B2 | 9/2003 | Litke | |
| 6,681,402 | B1 | 1/2004 | Bevier et al. | |
| 6,684,406 | B2 | 2/2004 | Fowler | |
| 6,701,530 | B2 | 3/2004 | Kleinert | |
| 6,799,333 | B2 * | 10/2004 | Morrow et al. | 2/161.1 |
| 6,813,780 | B2 | 11/2004 | Morrow | |
| 6,959,453 | B2 | 11/2005 | Best | |
| 7,000,256 | B2 | 2/2006 | Kleinert | |
| 7,275,268 | B2 | 10/2007 | Gait | |
| 7,370,373 | B2 | 5/2008 | Kohler | |
| 2003/0014805 | A1 * | 1/2003 | Morrow et al. | 2/161.1 |
| 2004/0010834 | A1 | 1/2004 | Sidlo | |
| 2004/0060096 | A1 | 4/2004 | Thiruppathi | |
| 2004/0093656 | A1 | 5/2004 | Morrow et al. | |
| 2004/0123372 | A1 | 7/2004 | Kleinert | |
| 2006/0107432 | A1 | 5/2006 | Cicero | |
| 2007/0261149 | A1 | 11/2007 | Gait | |
| 2008/0083048 | A1 | 4/2008 | Morrow et al. | |
| 2008/0104737 | A1 | 5/2008 | Shepherd | |
| 2008/0146981 | A1 | 6/2008 | Greenwald et al. | |
| 2008/0178359 | A1 | 7/2008 | Grilliot et al. | |

FOREIGN PATENT DOCUMENTS

| | | |
|---|---|---|
| DE | 2843448 | 4/1980 |
| DE | 3135756 | 4/1983 |
| WO | 03013292 | 2/2003 |
| WO | 2007103985 | 9/2007 |

OTHER PUBLICATIONS

Debeer, The Tropic, "Tropic" Glove, 2004.
Debeer, The Arctic, "Arctic" Glove, 2004.
Brine, "Winter" Glove, 2004.
Brine, "Performance" Glove, 2004.
Brine "Elite" Glove, 2004.
Brine "Element" Glove, 2004.
STX "Reflex" Glove, 2004.
STX "Winter" Glove, 2004.
STX "3/4 Finger" Glove, 2004.
1994-1995 STX Lacrosse Equipment Catalog, p. 8.
1987 Brine Lacrosse Catalog, pp. 12-13.
1983 Bacharach Rasin Lacrosse Catalog, p. 2.
1981 STX Catalog, page unknown.
1980 STX Lacrosse Catalog, page unknown.
1975 STX Lacrosse Catalog, p. 11.

* cited by examiner

PROTECTIVE SPORTS GLOVE WITH FLOATING CUFF PORTION

CROSS REFERENCE TO RELATED APPLICATIONS

The present application claims priority from U.S. Provisional Application Ser. No. 60/518,772, filed on Nov. 10, 2003, and entitled "Protective Sports Glove With Floating Cuff Portion," which application is hereby incorporated by reference.

TECHNICAL FIELD

The present invention relates generally to a protective sports glove having improved flexibility and protection. More particularly, the present invention relates to a protective sports glove that provides both increased flexibility and protection for a wearer's hand, wrist, and/or forearm.

BACKGROUND OF THE INVENTION

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. The areas of a player's hand that are particularly susceptible to injury are those where the glove flexes, because at those locations, the protective padding is typically constructed such that it can bend or flex with a player's joint. However, bending or flexing of the glove, such as at the wrist or knuckle area, can leave the player's joint exposed due to the bending away of the protective padding and, therefore, susceptible to injury.

Many current protective sports gloves utilize wrist guards to protect a player's wrist between the cuff and the hand portion which location can be exposed when a player's hand flexes during play. While most prior wrist guards provide adequate protection, they provide limited flexibility and adjustability and are therefore uncomfortable. Because of these limitations, they are often removed or not utilized by the players. It is also a problem to provide a protective guard for a player's wrist between the hand and the cuff portion that not only protects the player's wrist, but also provides desired flexibility. Most wrist guards are either overly bulky and limit flexibility or are too small and provide minimal protection.

Additionally, many prior protective gloves include cuff portions that are secured directly to the hand portion by stitching. The stitching limits the flexibility of a player's wrist and cannot be adjusted. U.S. Pat. No. 5,983,396 discloses a configuration where the cuff and the hand portion are attached to one another by lacing that allows for improved flexibility and also adjustability. However, the lacing typically must be done by hand and therefore requires significant labor time in order to manufacture the glove, thereby increasing its cost. Moreover, while the flexibility of these gloves is improved, it is still relatively limited.

Further, other protective gloves have been introduced that provide increased ventilation and breathability. For example, some protective gloves have been introduced that utilize mesh material on portions or the entirety of a player's palm and fingers. With some protective gloves, the mesh material is located in areas on the palm that are not primarily intended to contact a stick. Because of the amount of movement of the stick in a player's hand, such as through cradling or the like, locating the mesh portions in these non-high use areas minimizes the tendency of the mesh material to wear quickly and ultimately tear, therefore rendering the glove illegal for play. Moreover, other protective gloves have utilized vent holes in the back portion of the glove to provide increased ventilation. While these protective gloves provide increased ventilation, they do not make any provisions for increased protection or flexibility for a wearer's hand.

Additionally, the cuff portion of most current protective gloves does not fully cover the underside of a wearer's wrist or forearm. While lacing typically extends between and connects either end of the cuff portion, wearer's rarely tighten these up, because doing so would decrease the glove's flexibility and range of motion during play. Thus, wearer's typically leave the lace loose, which leaves the ends of the cuff portion spaced apart from one another, and leaves the underside of a wearer's wrist and/or forearm with no padding covering it, thereby making it susceptible to injury.

Therefore, a need exists for a protective sports glove that provides increased protection for a wearer's hand, wrist, and/or forearm without decreasing ventilation or flexibility. Moreover, a need also exists for a protective sports glove that maximizes both flexibility and protection.

SUMMARY OF THE INVENTION

It is an advantage of the present invention to provide a protective sports glove having a free-floating subcuff for increased protection of a wearer's forearm and/or wrist.

It is another advantage of the present invention to provide a protective sports glove that has die cuts or seams in the back portion that are configured to provide increased and more realistic flexibility consistent with the movement of a wearer's hand during play.

It is still another advantage of the present invention to provide a protective sports glove with increased ventilation for a wearer's hand.

It is yet another advantage of the present invention to provide a protective sports glove with a flared cuff for increased flexibility.

It is a related advantage of the present invention to provide a protective sports glove that provides increased protection for a wearer's wrist and/or forearm without sacrificing flexibility.

It is a further advantage of the present invention to provide a protective sports glove that provides increased protection in the thumb area without sacrificing flexibility.

It is still a further advantage of the present invention to provide a protective sports glove that has finger portions with increased flexibility that does not compromise protection thereto.

In accordance with the above and the other advantages of the present invention, a protective sports glove is provided. The glove includes a hand portion having a protective back and a palm portion opposing the protective back. The glove includes a cuff portion coupled to the hand portion for protecting a wearer's wrist and/or forearm. The glove includes a plurality of finger portions secured to and extending from the hand portion for receipt of a wearer's fingers therein. The glove also includes a subcuff portion disposed generally beneath the cuff portion. The subcuff portion extends circumferentially around a wearer's wrist and is flexibly coupled to the cuff portion such that as a wearer moves their hand from an unflexed position to a flexed position, the subcuff portion remains generally around the wearer's wrist to provide protection thereto while also maximizing flexibility.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
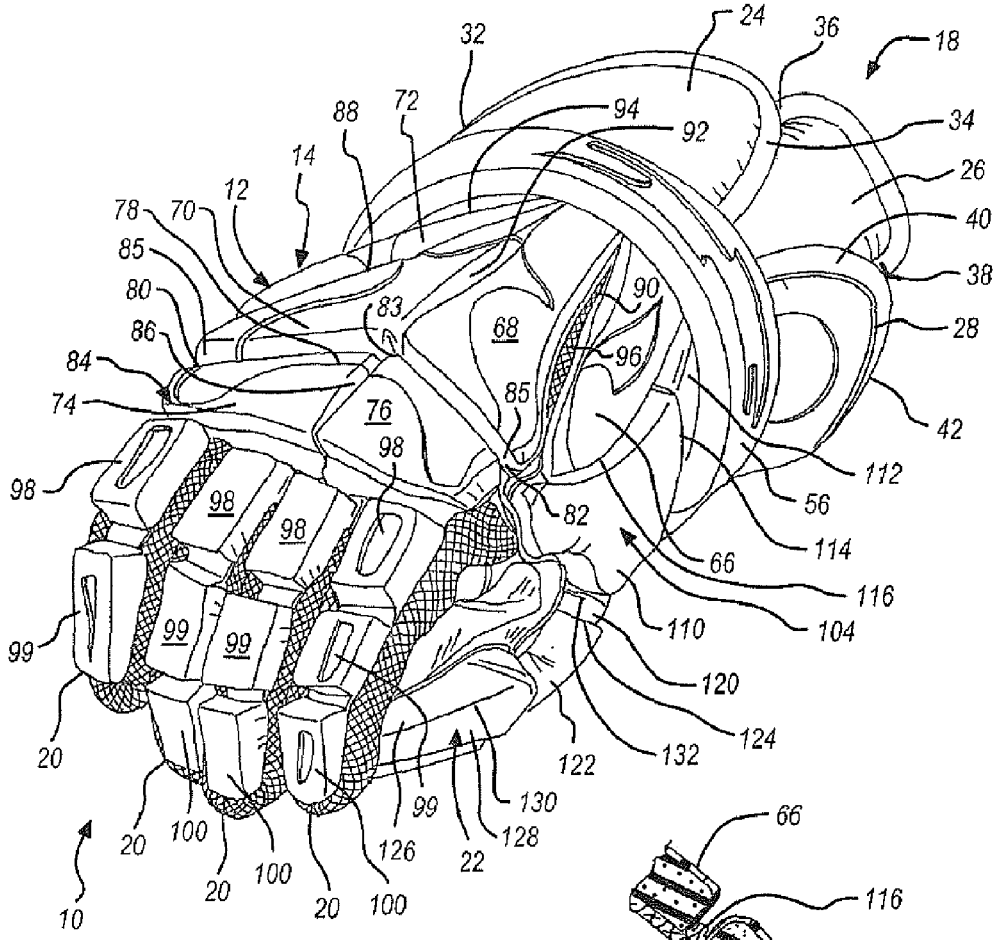
FIG. 1 is a perspective view of a protective sports glove in accordance with one embodiment of the present invention in a generally unflexed position.

As shown in the attached drawings, a protective sports glove is disclosed. The preferred application for the protective sports glove is in the game of lacrosse. However, the protective sports glove may be utilized in a variety of other suitable applications. For example, it should be understood that the disclosed glove might be used in any other contact stick sport, including ice or roller hockey.

Referring now to the Figures, which illustrate a protective sports glove 10 in accordance with the present invention. The glove 10 has a hand portion 12, including a top or back side portion 14 and a bottom or palm portion 16, which therebetween define an interior space for receipt of a wearer's hand. The glove 10 has a cuff portion 18, which is coupled to the hand portion 12, a plurality of finger portions 20 extending from the hand portion 12, and a thumb portion 22 also extending from the hand portion 12.

Referring now to FIGS. 1-4 and 6, the cuff portion 18 preferably has a first cuff segment 24, a second middle cuff segment 26, and a third cuff segment 28. The cuff portion 18 thus consists of multiple portions to provide a split cuff that yields increased flexibility for a wearer during play. It will be understood that the cuff portion 18 may be comprised of more or less segments as desired. The first cuff segment 24, the second middle cuff segment 26, and the third cuff segment 28 are each flexibly secured to the hand portion 12, as discussed in detail below. The first cuff segment 24 has a first edge portion 32 and a second edge portion 34. The second middle cuff segment 26 has a first edge portion 36 and a second edge portion 38. The third cuff segment 28 has a first edge portion 40 and a second edge portion 42.

In one embodiment, the second edge portion 34 of the first cuff segment 24 overlaps or overlies the first edge portion 36 of the second middle cuff segment 26. The first edge portion 40 of the third cuff segment 28 overlaps or overlies the second edge portion 28 of the second middle cuff segment 26. The first cuff segment 24, the second middle cuff segment 26, and the third cuff segment 28 are designed to cover and protect substantial portions of a user's wrist and/or forearm. The overlapping (split cuff) configuration of the cuff segments 24, 26, 28 provides added protection to a wearer's wrist and/or forearm because of the double layer of padding. In one embodiment, the cuff segments 24, 26, 28 are not affixed to each other along their respective adjacent edge portions 34, 36, 38, 40 and thus can move with respect to one another and provide increased flexibility for a wearer's wrist and/or forearm as it moves during play. It will be understood that the cuff segments may also be affixed to one another along some portion of each edge, if not along the entire edge, and still provide increased flexibility.

The first edge portion 32 of the first cuff segment 24 preferably has an attachment mechanism 44 formed therein. Similarly, the second edge portion 42 of the third cuff segment 28 has a second attachment mechanism 46 formed therein. Each of the attachment mechanisms 44, 46 are preferably eyelets. Further, more than one attachment mechanism can be incorporated into each of the segments 24, 28 or the attachment mechanism can be formed in a variety of different locations. A lace 48 or other securing device is preferably passed through the first and second attachment mechanisms 44, 46 to connect the first cuff segment 24 to the third cuff segment 28. As shown, the lace 48 is intended to pass around the underside of a wearer's forearm such that the tightness of the cuff segments 24, 28 with respect to a wearer's forearm may be adjusted to bring the cuff segments 24, 28 closer to one another and bring the padding around a wearer's forearm. The lace 48 may be maintained in its desired position at a desired tightness through the use of the cord lock 50 or other similar locking device. Alternatively, the lace 48 may be removed from the glove entirely.

Figure 8:
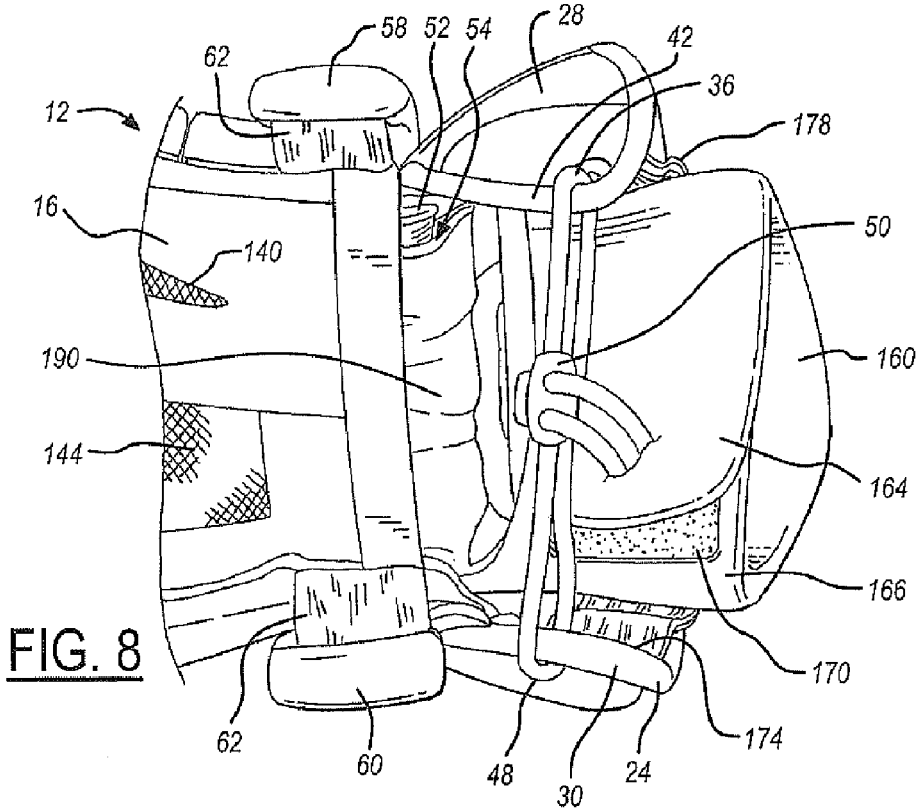
FIG. 8 is a partial view of a protective sports glove illustrating a subcuff portion in a secured position in accordance with one embodiment of the present invention.
Figure 9:
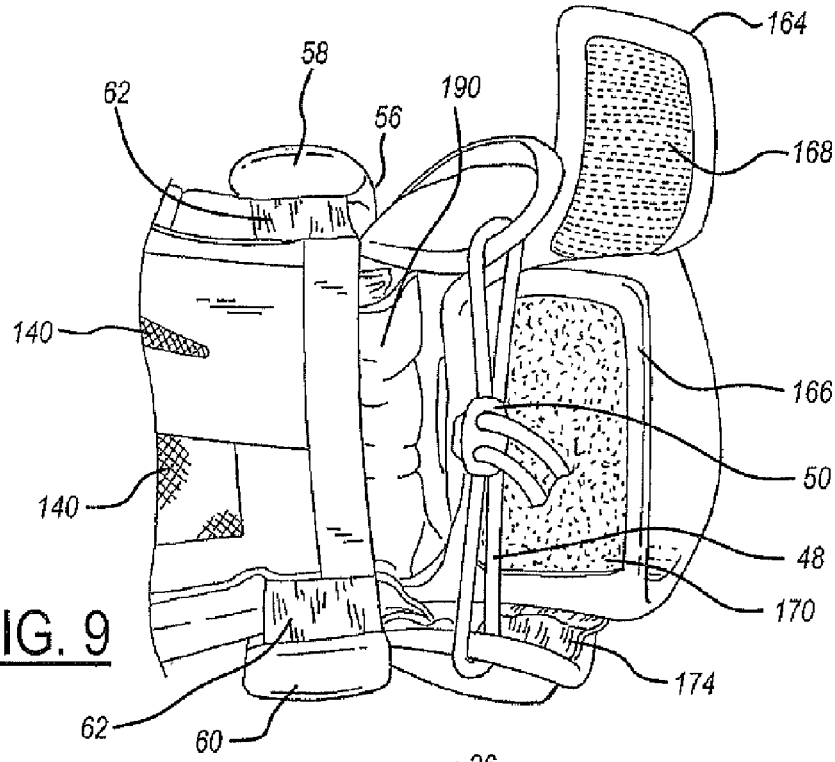
FIG. 9 is an illustration of the subcuff portion of FIG. 8 in an unsecured position.

As best shown in FIG. 8, the cuff portion 18 is preferably flexibly secured to the hand portion 12 through a plurality of elastic members 52. Each of the elastic members 52 is preferably secured at one end to the upper border of the cuff portion 18 and at an opposing end to the hand portion 12. This configuration keeps the cuff portion 18 secured to the hand portion 12, while allowing relative movement therebetween to provide flexibility as the wearer's hand flexes during play. The elastic members 52 are preferably disposed on either side of the cuff portion 18 with a third elastic member being disposed generally in the middle. It will be understood that more or less elastic members may be utilized and that the elastic members can be located in a variety of other suitable locations. Alternatively, the cuff portion 18 can be attached to the hand portion 12 by a segment of compliant material, such as neoprene, which also provides the desired flexibility. Obviously, other attachment mechanisms may be utilized.

As the cuff portion 18 moves with respect to the hand portion 12, the back of a player's wrist or hand can be exposed at a seam 54 formed therebetween. Accordingly, in one embodiment, a wrist guard 56 is disposed over the seam 54 between the cuff portion 18 and the hand portion 12. The wrist guard 56 is preferably a padded member and has a first end 58, which is preferably secured to the first cuff segment 24 adjacent the first edge portion 32. The wrist guard 56 has a second end 60 which is preferably attached to the third cuff segment 28 adjacent its second edge portion 42. The first and second ends 58, 60 of the wrist guard 56 are secured to the cuff portion 18 by sewing. It should be understood that the ends 58, 60 may be attached by any other known securing means. Alternatively, the wrist guard 56 could instead be secured to the hand portion 12. The integral attachment of the wrist guard 56 to the glove 10 prevents it from being removed unintentionally and therefore provides permanent protection. It will be understood that the wrist guard 56 can take on a variety of different configurations and have a variety of different attachment points.

In another embodiment, a plurality of elastic members 62 preferably couple the first end 58 and the second end 60 of the wrist guard 56 to the hand portion 12. The elastic members 62 allow the wrist guard 56 to flex or move as needed while a wearer's hand moves or flexes during play and still remain over the seam 54. In other words, the elastic members 62 allow the wrist guard 56 to move as the wearer's hand moves and still remain over the seam 54 and above the back side portion 14 of the glove 10 and particularly over the seam 54. Alternatively, the wrist guard 56 may be disposed within the interior space of the glove 10 to cover the seam 54 from beneath the back side portion 14.

Figure 7:
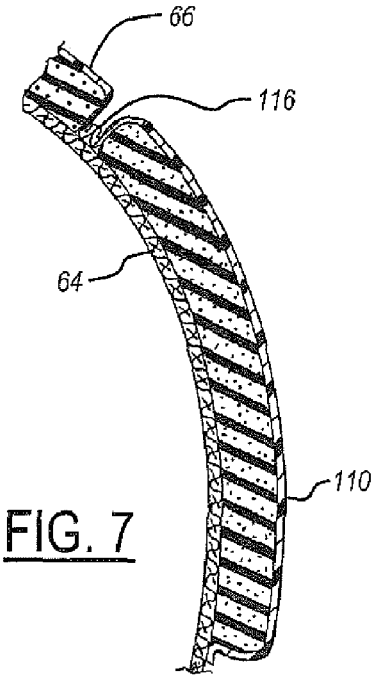
FIG. 7 is a cross-sectional view of the protective sports glove of FIG. 6 in the direction of the arrows 6-6.
Figures 2, 5:
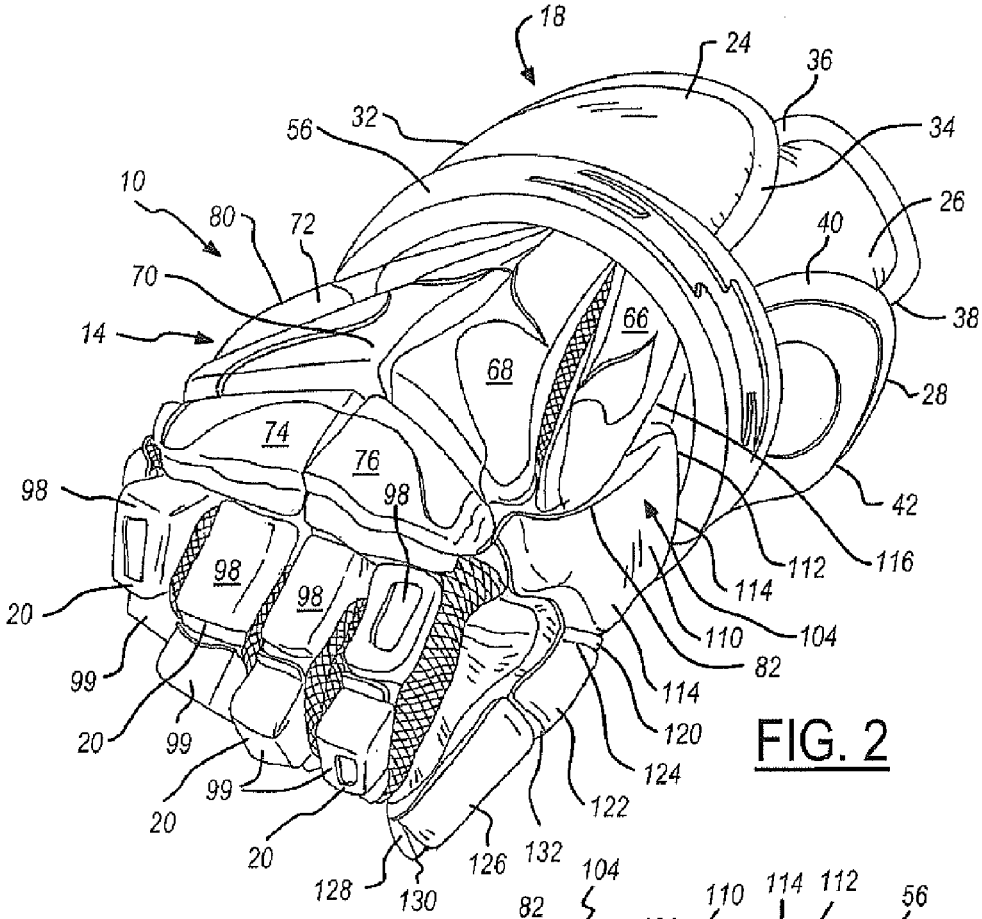
FIG. 2 is a perspective view of the protective sports glove of FIG. 1 in a generally flexed position.
FIG. 5 is a bottom view illustrating the palm portion of the protective sports glove of FIG. 1.
Figure 4:
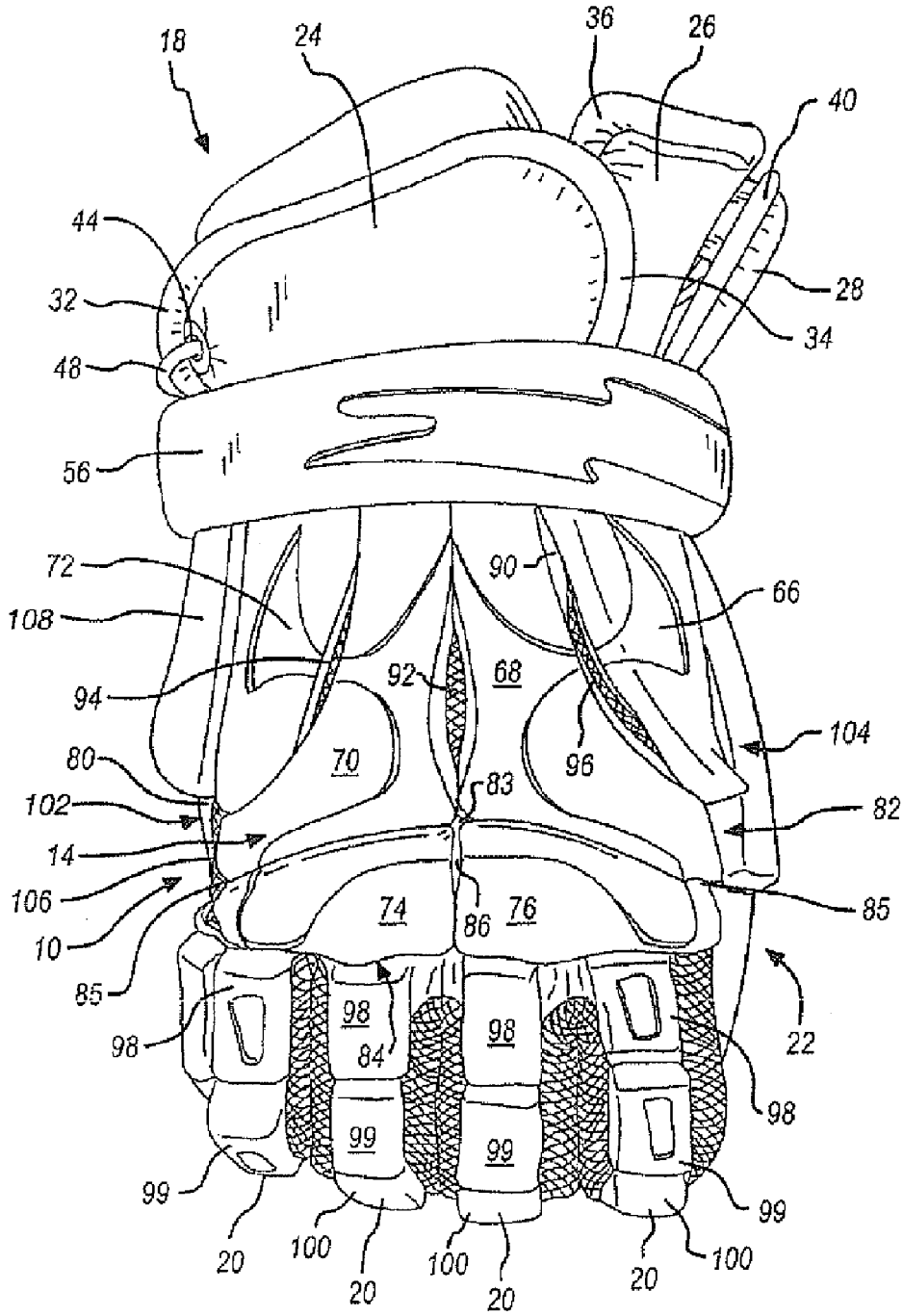
FIG. 4 is a top view illustrating the back side portion of the protective sports glove of FIG. 1.
Figure 6:
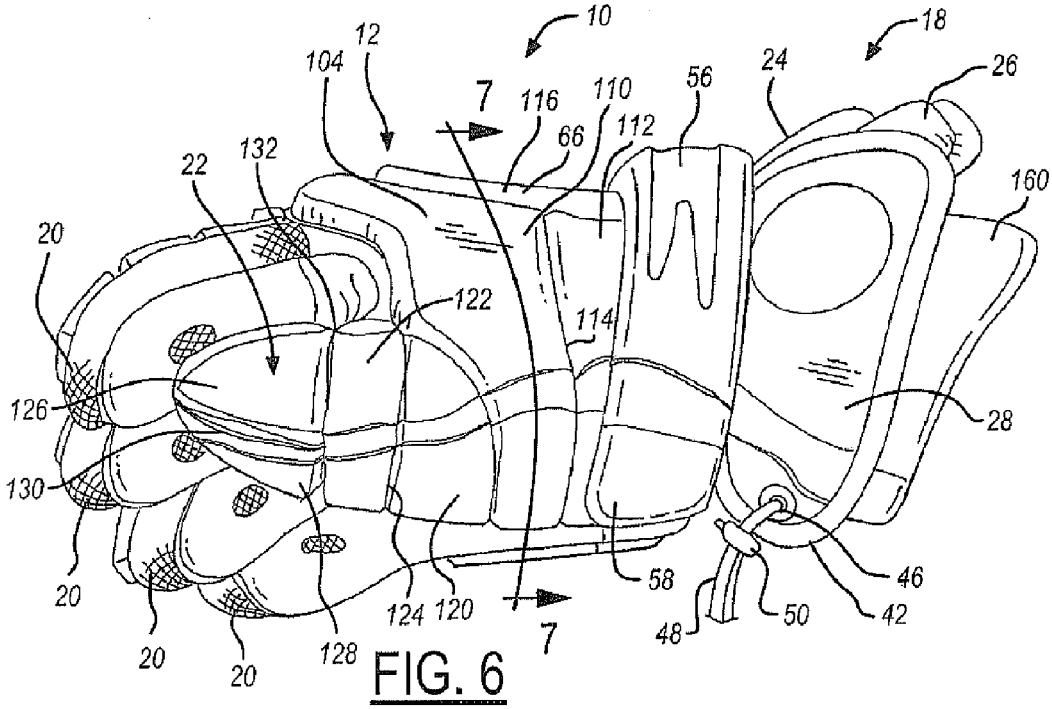
FIG. 6 is a view illustrating the thumb side of the protective sports glove of FIG. 1.

With reference to FIGS. 1, 2 and 4, the hand portion 12 extends generally between the seam 54 and the finger portions 20 and includes the back side portion 14 and the palm portion 16. The back side portion 14 preferably has an inner fabric 64 (FIG. 7) having a plurality of protected padded portions secured thereto. As shown, the back side portion 14 is preferably subdivided into a plurality of individual protective padded portions 66, 68, 70, 72, 74, 76. The back side portion 14 of the glove 10 has a first lengthwise concave cut or moon shaped cut 78, that generally extends from one side 80 of the hand portion 12 to the other side 82 of the hand portion 12, which allows the glove to flex along the lengthwise cut 78 as a wearer's hand moves. This cut or seam 78 is configured such that a middle portion 83 is closer to the cuff portion 18 than the end portions 85. This provides a more ergonomically flexible glove to more accurately conform to a wearer's hand as it flexes within the glove. Specifically, the lengthwise concave cut 78 is configured so that the protective padded portions 74 and 76 are moveable with respect to the adjacent protective padded portions 68 and 72. It will be appreciated that the lengthwise concave cut 78 can take on other configurations.

Figure 3:
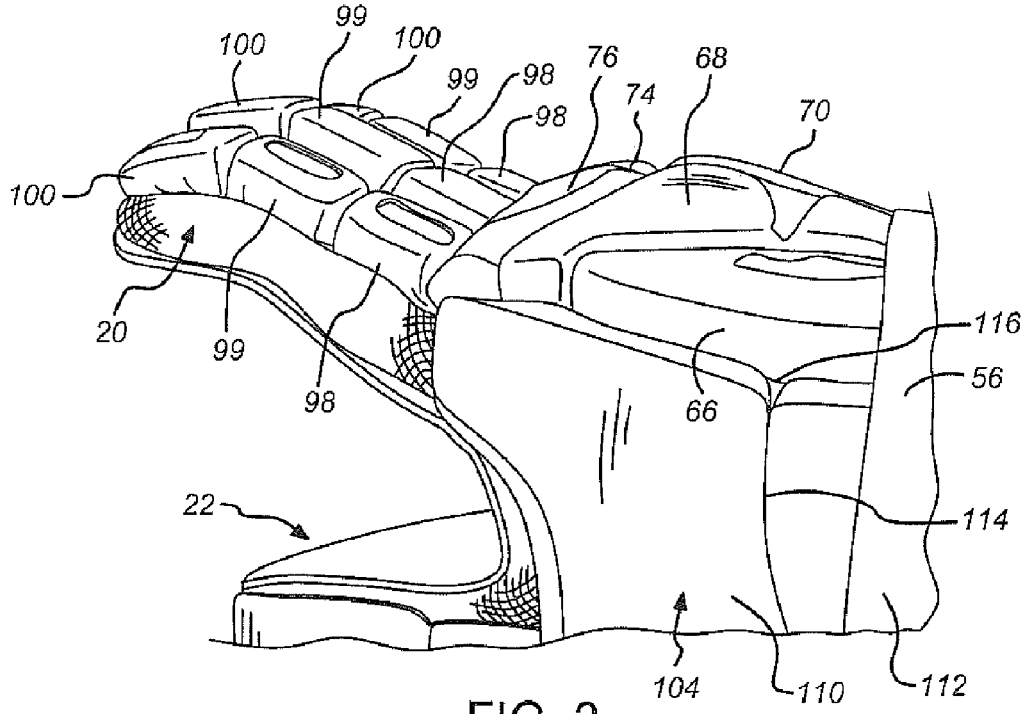
FIG. 3 is a side view of the protective sports glove of FIG. 1 with the fingers in a fully extended position.
Figure 15:
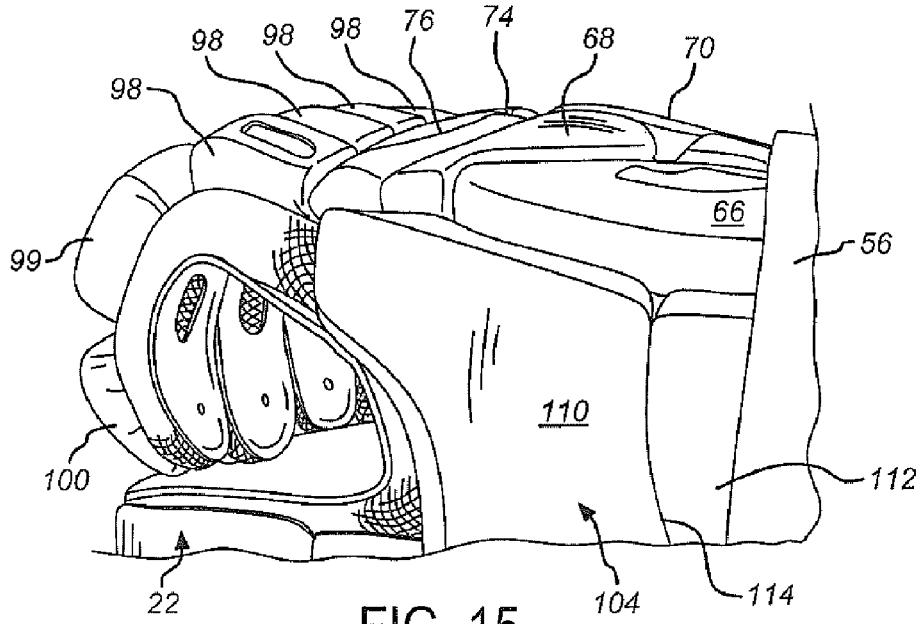
FIG. 15 is a side view of the protective sports glove of FIG. 1 with the fingers in a curled position.

As best shown in FIGS. 3 and 15, the configuration of the lengthwise concave cut 78 allows the padded positions 68, 70 disposed on either side of vertical cut 86 to move upward slightly relative to the padded portion 66, 74, 76 when the finger portions 20 are straightened. By this configuration, minimal spacing exists between the padded portions. Conversely, when the finger positions 20 are curled, the padded portions 68, 70 slide downward back into the same general plane as the padded portion 66, 74, 76. In this way, the padded positions 66, 68, 70, 72, 74, 76 provide maximum protection for a wearer's hand, regardless of finger position, leaving only tiny gaps between the pads 66, 68, 70, 72, 74, 76, but allowing for flexibility.

The protective padded portions 74, 76 terminate at a junction 84 between the hand portion 12 and the finger portions 20. The junction 84 allows the finger portions 20 to move with respect to the padded portions 74 and 76 as the junction 84 is generally disposed over a wearer's knuckle area, allowing the finger portions 20 to move as a wearer's fingers flex. Additionally, the back side portion 14 has a vertical cut 86 that extends generally from the cuff portion 18 to the junction 84. The vertical cut 86 allows the protective padded portions 68 and 76 to move with respect to the protective padded portions 72 and 74, allowing the glove 10 to bend around an axis defined by the vertical cut 86. The vertical cut 86 allows the glove 10 to fit more comfortably as it allows the glove to better conform to a wearer's hand as it closes around a stick, therefore, providing a tighter shape and better fit. This is necessary as the back of a typical wearer's hand is not flat, and the padded protected portions 68, 70, 74, 76 are not flexible enough to bend sufficiently without the vertical cut portion 86. Thus, prior gloves tend to flatten out as a wearer flexes his hand, which causes additional tension to be applied to the palm portion 16.

The back side portion 14 of the hand portion 18 also preferably has a pair of opposing angled cuts 88 and 90 which begin generally at the base of the hand portion 12 adjacent the seam 54 and extend generally outward to the respective side 80, 82 of the hand portion 12. The angled cuts 88, 90 similarly assist the glove 10 in conforming to the wearer's hand as the protective padded portions 66, 72 can each independently move with respect to the other padded portions as a wearer's hand flexes during play, thus providing a better fitting glove. As shown, the angled cuts 88, 90 preferably extend in an arcuate or curved fashion. However, they may alternatively extend in a linear fashion. Alternatively, the angled cuts 88, 90 may be located in other areas of the back side portion 14. The cuts 78, 84, 86, 88, and 90, are preferably formed in the glove 10 through die cutting or other known cutting or forming means, which are sufficient to configure the back side portion 14 of the glove 10 to conform to the configuration described above. The back side portion 14 may have a variety of additional or different cuts as desired. Moreover, the cuts or seams described above may have a variety of different configurations.

The back side portion 14 of the hand portion 12 has a plurality of vent openings formed therein to provide ventilation to a wearer's hand. In one embodiment, the vent openings are slots that are formed between adjacent protective pads such as by separating the pads. A first vent opening 92 is preferably disposed along the vertical cut 86 between the protective padded portion 68 and the protective padded portion 72. A vent opening 94 is preferably disposed along the first angled cut 88 between the protective padded portion 70 and the protective padded portion 72. Another vent opening 96 is preferably disposed along the second angled cut 90 between protective padded portions 66 and 68. The vent openings 92, 94, 96 are located along die cuts 86, 88 and 90, and preferably do not correspond to the joints of a wearer's hand and, therefore while there is some relative movement of the protective pads in which the vent openings are formed, the movement is not sufficient to cause a portion of a wearer's hand to be exposed. In this disclosed embodiment, the vent openings are preferably formed by separating the pads a further distance from one another instead of cutting away any of the padded portions. It will be understood that the vent openings may be formed in a variety of other suitable ways.

Additionally, a piece of breathable material, such as mesh, is disposed in each of the vent openings. However, the breathable material can be any other suitable material. In one embodiment, the vent openings 92, 94, 96 are located along non-horizontal cuts and thus can be made larger as the potential for exposure is minimal. It should be understood that while three vent openings are disclosed on the back side portion 14 of the glove 10, any number of vent openings might be utilized. Additionally, the vent openings may be disposed in a variety of other locations along the back side portion 14 in accordance with the preferred embodiment, including within or through the respective individual padded portions themselves, instead of along the die cuts or along the horizontal, angled or concave cut or seams. Moreover, the vent openings may have a variety of different configurations.

The finger portions 20 each extend from the junction 84 and are each divided into three separate padded portions 98, 99, 100. Further the spaces between the padded portions 98, 99, 100 are relatively small to minimize the chance of a wearer's finger being injured if contacted with a stick while the pads are separated such as when a wearer is clenching his fist. However, the pinkie finger only has two padded portions 98, 99. As with the padding on the hand portion 12, each of the padded portions 98, 99, 100 on the finger portions 20 is disposed on an inner fabric layer 64 that overlies the interior of each of the finger portions 20. The hand portion 12 of the glove 10 has a first side portion 102 connecting the back side portion 14 to the palm portion 16 and a second side portion 104 connecting the back side portion 14 to the palm portion 16 on its other side.

The first side 102 of the glove 10 preferably includes a breathable layer 106, such as a mesh material, extending between the back side portion 14 and the palm portion 16 with a protective padded portion 108 secured thereon. The second side 104 of the glove 10 has a protected padded portion that is sub-divided into a first padded portion 110 and a second padded portion 112 by a die cut 114 or seam formed therein. The first padded portion 110 extends from a region abutting padded portions 66, 68 and over a portion of the wearer's thumb to the palm portion 16 for increased protection. This padded portion 110 is thus a single unitary pad which because of its unitary structure along the entire side of the glove provides for increased fit and form as well as increased protection due to the absence of any seam in this padded portion. A seam 116 extends between the padded portion 66 and the padded portion 110 for added flexibility. The thumb portion 22 has a plurality of protected padded portions formed thereon. The thumb portion 22 has a first padded portion 120 disposed adjacent a second padded portion 122 and separated by a seam 124. The second padded portion 122 is disposed adjacent a third padded portion, which is subdivided into a first part 126 and a second part 128 by a die cut or seam 130. A second die cut 132 is disposed between the second padded portion 122 and the first and second parts of the third padded portion 126, 128.

Referring now to FIGS. 5 and 8, which illustrate the palm portion 16 of the glove 10. The palm portion 16 extends from the lower edge of the hand portion 12 adjacent the seam 54 to the tips of the finger portions 20 and the tip of the thumb portion 22. The palm portion 16 is attached to each of the respective padded portions 98 of each finger portion 20 by a breathable layer 136, such as a mesh. The breathable layer 136 allows for flexibility of the fingers within the finger portions 20 as well as to provide sufficient ventilation through the breathable layer 136 to a wearer's fingers. As shown, the palm portion 16 is preferably comprised of a durable material such as leather, a synthetic material, or any other known suitable material, generally illustrated by reference number 138. The durable material preferably includes a textured surface, such as a nash, to provide a wearer with a better grip of a handle or stick. Breathable portions 140, 142 and 144, such as mesh, are preferably located throughout the palm portion 16 to provide ventilation to a wearer's palm. It will be appreciated by one of ordinary skill in the art that other suitable breathable materials may be utilized. In one embodiment, the breathable portions 140, 142, and 144 are located in the palm portion 16 in areas that are not intended as primary contact areas for a stick.

The first breathable portion 140 is preferably located at the junction between the palm portion 16 and the thumb portion 22. The first breathable portion 140 allows the thumb portion 22 to move with respect to the palm portion 16 without causing the palm material to bunch or bulge as typically occurs if the entire palm portion 16 is formed of a wear-resistant material. Additionally, the second breathable portion 142 is disposed on the palm portion 16 at the junction 84 between the hand portion 12 and the finger portions 20 to allow relative movement therebetween and to prevent bunching up of material at that joint as would typically occur if that portion were comprised of a wear-resistant material. Each of the finger portions 20 has a plurality of finger vent holes 148 formed in the durable wear-resistant material to provide ventilation to the wearer's fingers. The finger vent holes 148 are preferably formed by punching and must be formed far enough apart to prevent the durable material from ripping or tearing. The finger portions 20 also have a larger breathable portion 146, such as mesh, located further away from the palm portion 16 than the finger vent holes 148 to provide additional ventilation to the finger portions of the wearer's palm. The third breathable portion 144 is also disposed in areas that are not likely to wear due to contact with a stick. The third breathable portion 144 is also disposed in locations that allow the glove to flex and therefore prevent bunching. Further, all of the breathable portions 140, 142, 144, 146, provide ventilation to the wearer's palm. It should be understood that more or less breathable portions may be included and the locations shown are merely exemplary and may obviously vary.

Referring now to FIGS. 8, and 10-12, a subcuff portion 160 of the glove 10 is shown, the subcuff portion 160 is substantially contained within the cuff portion 16. The subcuff portion 160 is preferably configured as a unitary padded strip consisting of a middle region 162 and a pair of end portions 164, 166. The middle region 162 preferably is formed with foam padding or other protective material to protect the wearer's hand and wrist. A hook and loop attachment 168, 170 is coupled to each respective end portions 164, 166 of the subcuff portion 160. The subcuff portion 160 is also secured to the inner side 172 of the first cuff segment 24 using an elastic member 174 and to the inner side 176 of the third cuff segment 28 using another elastic member 178. It will be understood that the subcuff portion 160 can be attached to the cuff portion 18 in a variety of different ways, i.e. more or less elastic straps, or other compliant material or at a variety of different locations. Alternatively, the subcuff portion 160 can be flexibly attached to other portions of the glove 10. Further, the end portions 164, 166 of the subcuff portion can be secured to one another by a variety of other suitable ways. In fact, the subcuff portion 160 could be formed as a single unitary piece with sufficient flexibility to allow a wearer to fit their hand therethrough.

In one embodiment, the wearer of the glove 10 inserts their hand within the interior space 180 of the glove 10 with the hook and loop attachments 168, 170 uncoupled from each other. To ensure proper fit, the subcuff portion 160 is positioned circumferentially around the wearer's wrist when the wearer has completely inserted their hand within the interior region of the glove 10 such that the wearer's fingers extend to the tips of the respective finger portions 20. The wearer then attaches the hook and loop attachment 168, 170 together around the wearer's wrist such that the middle region 162 of the subcuff portion 160 substantially covers and protects the wearer's wrist and hand by substantially surrounding the circumference of the wearer's wrist as the end portions 164, 166 are secured by connecting to hook and loop attachments 168, 170. The hook and loop attachments 168, 170 allow the subcuff portion 160 to be secured tightly around the wrist during play for maximum protection and playability. To remove the glove after play, a wearer first uncouples the end portions 164, 166 from one another to allow the wearer to easily remove their hand from the interior 180 region of the glove. The hook and loop attachments 168, 170 allow the wearer to decide how tightly or loosely they wish to secure the subcuff portion 160 circumferentially around their wrist. Of course, while hook and loop attachments are the preferred method for coupling together the ends 164, 166 of the subcuff portion 160, other methods well known to those of ordinary skill in the art may also be utilized. For example, a lace could be threaded through the ends 164, 166 and tied such that the subcuff portion 160 is secured completely around a wearer's wrist and/or forearm.

Because the subcuff portion 160 is only coupled to the cuff portion 18 using elastic members 174, 178 (i.e. the subcuff portion 160 "floats" within the cuff region 18), the wearer of the glove 10 is allowed substantial wrist movement in any direction while conforming to protect a wearer's hand and wrist as it moves during play. In other words, the subcuff portion 160 moves independently of and with respect to the cuff portion 18. This is emphasized especially in FIGS. 11 and 12, which shows the ability of the subcuff portion 160 to float between an unflexed position (FIG. 11) and flexed position (FIG. 12), wherein the wearer flexes his hand forward (i.e. wherein the palm of the hand moves closer to the wrist and wherein the back of the hand moves further away from the wrist). It will also be understood that the amount of free floating between the subcuff portion 160 and the cuff portion 18 may be adjustable through an adjustable attachment therebetween.

Figure 11:
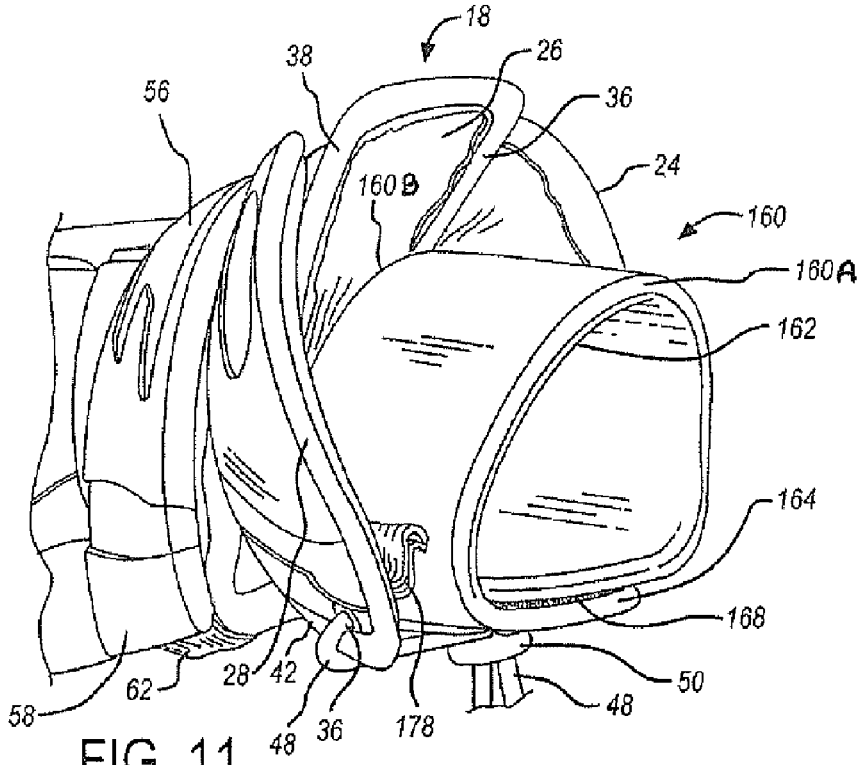
FIG. 11 is a partial perspective view illustrating the subcuff portion of FIG. 8 in a generally unflexed position.
Figure 12:
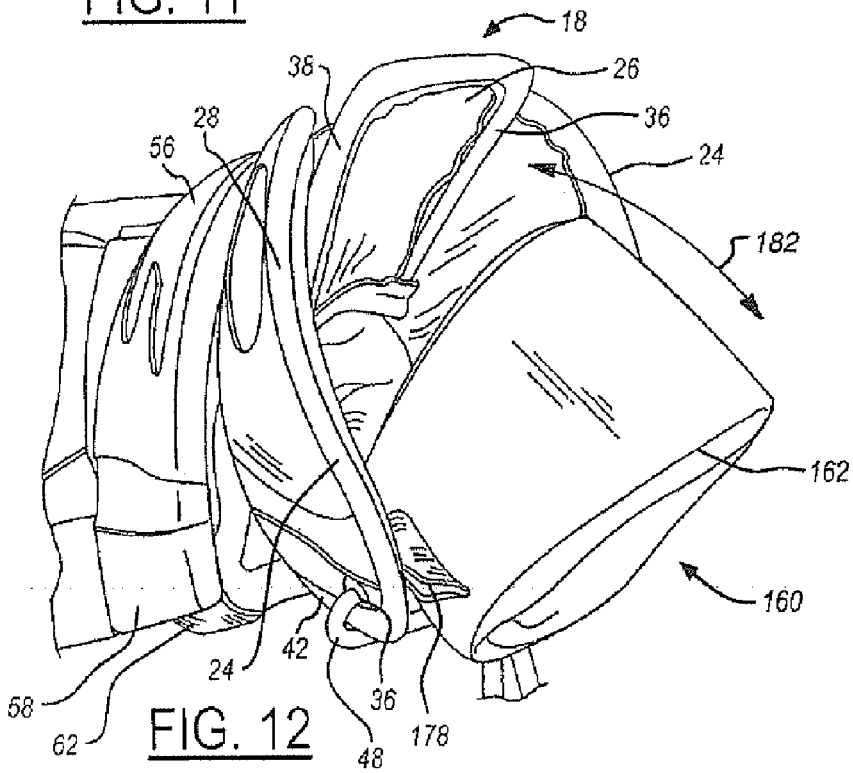
FIG. 12 is a partial perspective view illustrating the subcuff portion of FIG. 8 in a generally flexed position.

As shown best in FIG. 11, when the wearer's wrist is in an unflexed position, characterized wherein the length of the wearer's forearm is substantially planar to the back of a wearer's hand, a plane along the length of the subcuff portion 160 defined by the edge portions 160A, 160B of the subcuff portion 160 also runs substantially planar to the back side portion 14 of the glove 10. In other words, in the unflexed position, a wearer's palm is generally planar to the underside of the wearer's forearm. In this un-flexed position, the interior of the subcuff portion 160 substantially abuts the circumference of the wearer's wrist, hand and forearm. In the flexed position, as shown in FIG. 12, characterized wherein the palm portion 16 of the hand flexes forward towards the wrist, characterized by arrows 182, the subcuff portion 160 floats to remain substantially co-planar with respect to the wearer's forearm length, and substantially non-planar with respect to the wearer's hand. In other words, in the flexed position, the edge portions 160A, 160B do not lie in the same plane as the back side portion 14 of the glove 10. In this way, when the glove is flexed, the interior of the subcuff portion 160 remains substantially abutted to the circumference of the wearer's wrist, therein allowing maximum protection to the wrist as the subcuff portion 180 overlies a wearer's wrist throughout the hand's full range of motion. In addition, the subcuff portion 160 allows for maximum rotation of the wearer's wrist, therein allowing maximum playability for the wearer.

Figure 10:
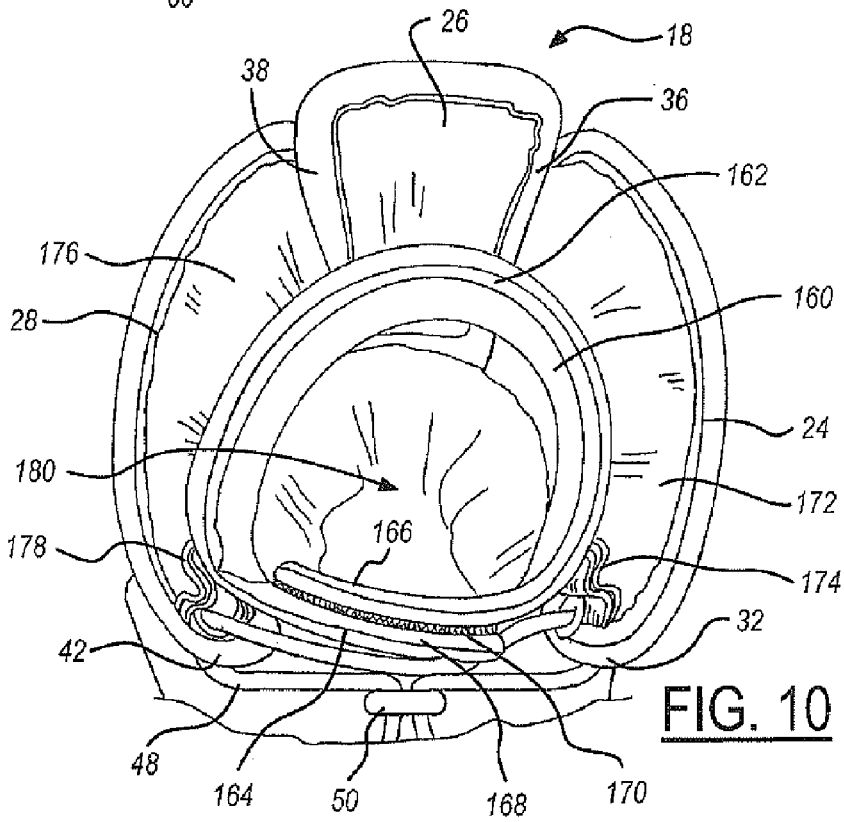
FIG. 10 is an end view illustrating an interior portion of the protective sports glove of FIG. 1.

As shown best in FIGS. 10 through 12, the cuff portion 18 is flared outwardly with respect to the back side portion 14 of the wearer's hand. With conventional gloves, the cuff portion 18 extends from the glove such that it is oriented generally planar to the back side portion 14 of the glove 10. The outwardly flared orientation in this embodiment allows for maximum flexibility, as the wearer will be able to more readily flex his hand during play without the range of motion being impeded by the cuff portion. By flaring the cuff outwardly, the hand and wrist have a larger range of travel. In one embodiment, the cuff portion 18 is outwardly flared at approximately a 45° angle. This flared cuff 18 thus provides maximum flexibility and in combination with the subcuff portion 160 which provides protection to a wearer's wrist when the glove is flexed also yields maximum protection. The degree to which the cuff portion 18 is flared can change. In the embodiment shown in the drawings, each of the segment 24, 26, 28 are outwardly flared, i.e. the lower edge is disposed further away from the wearer's forearm than the upper edge. However, the second edge portion 24 of the wrist cuff segment is flared outwardly more than the first edge portion 32. Similarly the first edge portion 40 of the third cuff segment 28 is flared outwardly more than the second edge portion 42.

Figure 13:
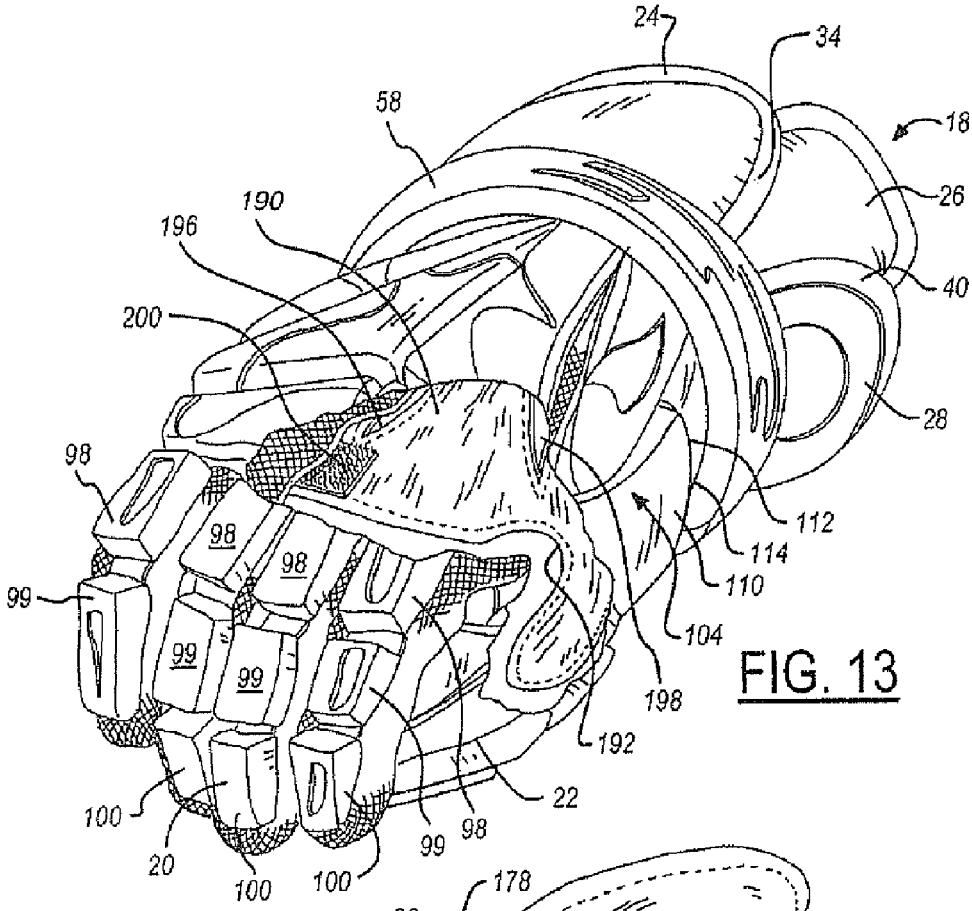
FIG. 13 is a partially sectioned perspective view illustrating a liner pad coupled within the interior portion of the protective sports glove of FIG. 1.
Figure 14:
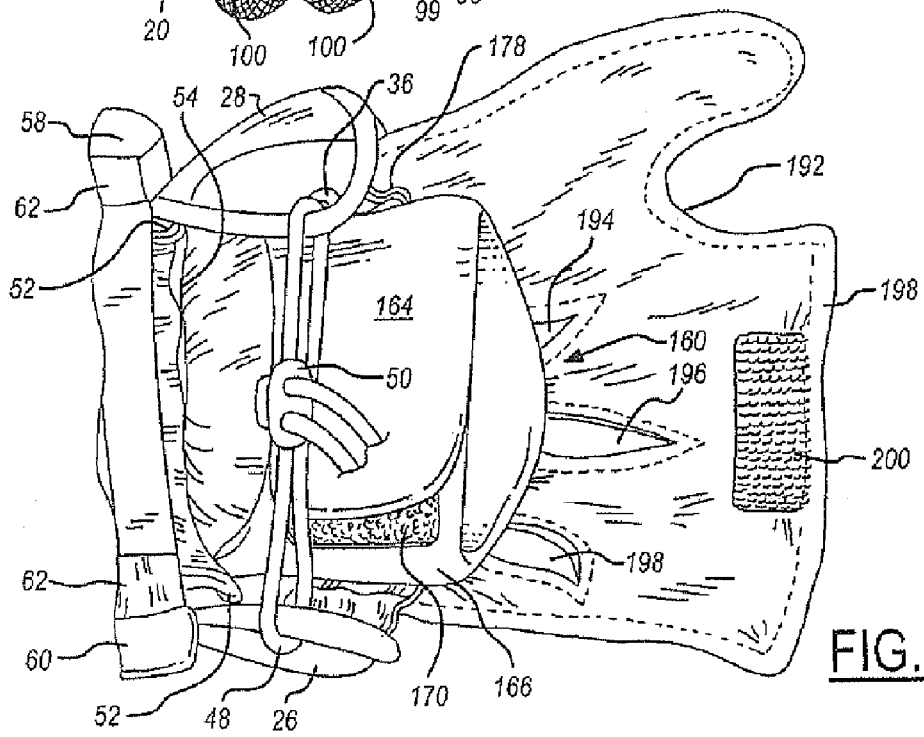
FIG. 14 is a bottom view of the protective sports glove of FIG. 1 illustrating the liner pad in an exposed position.

Also shown on FIGS. 13 and 14 is an internal liner pad 190 contained within the subcuff portion 160 and coupled to the seam 52. The internal liner pad 190 provides a tighter fit for a wearer's hand within the interior region of the glove 10 that enhances playability and protection. The internal liner pad 190 has an inlet 192 that corresponds to the thumb portion 22 when the liner pad 190 is tucked within the interior region of the glove. The liner pad 190 also has a plurality of openings 194, 196, 198 that correspond with vent portions 92, 94, and 96. This allows ventilation to the wearer's hand when the internal liner pad 190 is tucked within the interior region of the glove 10. A hook and loop attachment 200 is located at the end of the liner pad 190, which couples to the interior region of the glove near the vertical seam 86 to secure the liner pad 190 within the interior region, as best shown in FIG. 13. The liner pad 190 may be placed in an open position, as shown in FIG. 14, to allow the liner pad 190 and interior region of the glove to dry during non-use. The inner liner pad 190 can be attached to the glove at a variety of different locations as will be understood by one of ordinary skill in the art.

While particular embodiments of the invention have been shown and described, numerous variations and alternate embodiments will occur to those skilled in the art. Accordingly, it is intended that the invention be limited only in terms of the appended claims.

What is claimed is:

1. A protective sports glove, comprising:

a cuff portion for overlying at least a portion of a wearer's forearm;

a hand portion coupled to said cuff portion, said hand portion having a palm portion and an opposing back portion with a plurality of protective padded portions secured thereon, said hand portion having a first side and a second side, said first side defined between one edge of said palm portion and said opposing back portion and said second side defined by an opposing edge of said palm portion and said opposing back portion;

a plurality of finger portions secured to and extending from said hand portion for receipt of a wearer's fingers therein;

a thumb portion secured to and extending from said hand portion; and a subcuff portion generally circumferentially disposed around a wearer's wrist and disposed within said cuff portion in spaced relation from said cuff portion about the circumference of said subcuff portion, said subcuff portion flexibly coupled to the glove by material extending between said subcuff portion and the glove for independent movement of said subcuff portion relative to said cuff portion, wherein the subcuff remains generally circumferentially disposed around at least one of a wearer's wrist and forearm as the wearer flexes their wrist during play, wherein the subcuff includes a front edge generally facing toward the hand portion and a rear edge spaced away from the front edge, the rear edge generally facing away from the hand portion, wherein the front edge is free from attachment so as to define a gap adjacent and forward of the front edge, wherein when the subcuff independently moves relative to the cuff portion, the gap adjacent and forward of the front edge at least one of widens and narrows.

2. The protective sports glove of claim 1, wherein said cuff portion comprises a split cuff portion having a plurality of cuff segments with at least one cuff segment at least partially overlying a second cuff segment.

3. The protective sports glove of claim 1, wherein said subcuff portion has a first end, a middle region, and a second end, wherein said first end is capable of being releasably coupled to said second end to secure said subcuff portion around the entirety of said wearer's wrist.

4. The protective sports glove of claim 3, wherein said first end is coupled to said second end by a hook and loop attachment.

5. The protective sports glove of claim 3, comprising:

a seam defined by said cuff portion and said hand portion; and a junction defined between said plurality of finger portions and said hand portion, wherein said back portion has a lengthwise moon shaped cut extending generally from said first side to said second side such that a middle portion of said lengthwise moon shaped cut is located closer to said seam than to said junction.

6. The protective sports glove of claim 5, wherein said lengthwise moon shaped cut allows a first pair of said plurality of padded portions to flex relative to a second pair of said plurality of padded portions along said lengthwise moon shaped cut, wherein said first pair of said plurality of padded portions is located between said lengthwise moon shaped cut and said junction and wherein said second set of padded portions is located between said lengthwise moon shaped cut and said seam.

7. The protective sports glove of claim 5, comprising a first pair of padded portions and a second pair of padded portions adjacent the opposing back portion;

a vertical cut extending from said junction to said seam, said vertical cut separating a first pair of padded portions from another of said first pair of padded portions and separating one of said second pair of padded portions from the other of said second pair of padded portions, wherein said vertical cut allows said glove to more closely conform to a wearer's hand.

8. The protective sports glove of claim 1, wherein said subcuff portion is secured to an inner side of said cuff portion using at least one elastic member.

9. The protective sports glove of claim 8, wherein said subcuff portion is secured to an inner side of said cuff portion with an elastic member joined with an outer surface of the subcuff portion.

10. The protective sports glove of claim 1 wherein the subcuff portion includes an outer surface and opposing portions that are configured to be positioned on opposing sides of at least one of the wearer's wrist and forearm, wherein the cuff portion includes an inner surface facing the outer surface of the subcuff portion, wherein an elastic member is joined between one of the opposing portions and the inner surface of the cuff portion.

11. The protective glove of claim 1, wherein said cuff portion has at least a portion that flares outwardly away from said wearer's wrist along its length.

12. The protective sports glove of claim 1 wherein the subcuff portion includes a middle region including padding, and a first end and a second end, wherein the first end is joined to an interior surface of the cuff portion with the material, and wherein the material is an elastic member.

13. A protective sports glove, comprising:

a cuff portion for engaging at least a portion of a wearer's forearm;

a hand portion flexibly coupled to said cuff portion, said hand portion having a palm portion and an opposing back portion with a plurality of protective padded portions secured thereon, said hand portion having a first side and a second side, said first side defined between one side of said palm portion and said opposing back portion and said second side defined by another side of said palm portion and said opposing back portion;

a first seam defined between said cuff portion and said hand portion;

a plurality of finger portions secured to and extending from said hand portion for receipt of a wearer's fingers therein, said plurality of finger portions and said hand portion defining a junction therebetween; and a thumb portion secured to and extending from said hand portion;

wherein said back portion has a lengthwise moon shaped cut extending from said first side at one end portion of said cut to said second side at another end portion of said cut such that a middle portion of said lengthwise moon shaped cut between said end portions is located closer to said first seam than said end portions and forms a lowermost portion of the moon-shaped cut, wherein the opposing back portion includes a knuckle seam adjacent the plurality of finger portions and adjacent knuckles of a wearer of the glove to facilitate movement of at least one of the fingers and the knuckles, wherein the lowermost portion is spaced away from the first seam, and is located between the first seam and the knuckle seam.

14. The protective sports glove of claim 13, wherein said lengthwise moon shaped cut allows a first pair of said plurality of padded portions to flex relative to a second pair of said plurality of padded portions along said lengthwise moon shaped cut, wherein said first pair of said plurality of padded portions located between said lengthwise moon shaped cut and said junction and wherein said second set of padded portions is located between said lengthwise moon shaped cut and said first seam.

15. The protective sports glove of claim 14, comprising:

a vertical cut extending from said junction to said first seam, said vertical cut separating one of said first pair of padded portions from the other of said first pair of padded portions and separating one of said second pair of padded portions from the other of said second pair of padded portions, wherein said vertical cut allows said glove to more closely conform to a wearer's hand.

16. The protective sports glove of claim 13, comprising:

a first angled cut extending away from said seam to said first side at a position between said first seam and said junction; and a second angled cut extending away from said first seam to said second side at a position between said first seam and said junction, wherein said first angled cut and said second angled cut assist in conforming the protective glove to the wearer's hand during use.

17. The protective sports glove of claim 13, comprising:

a subcuff portion that is elastically coupled to the glove and configured to be disposed about a wearer's wrist such that said subcuff portion moves in conjunction with a wearer's hand independently of said cuff portion to provide protection to the underside of the wearer's wrist during play.

18. The protective sports glove of claim 17, wherein said subcuff portion is padded and extends substantially around the circumference of a wearer's wrist.

19. The protective sports glove of claim 18, wherein said subcuff portion has a first end and a second end, which are releasably engageable through a hook and loop attachment, such that said subcuff portion extends entirely around said wearer's wrist, and such that said subcuff portion can be opened to separate and move the first and second ends away from one another so that a user can remove their wrist from the subcuff portion.

20. A protective sports glove, comprising:

a cuff portion for overlying a portion of a wearer's forearm;

a hand portion coupled to said cuff portion, said hand portion having a palm portion and an opposing back portion with a plurality of protective padded portions secured thereon;

a plurality of finger portions secured to and extending from said hand portion for receipt of a wearer's fingers therein;

a thumb portion secured to and extending from said hand portion; and a subcuff portion that is coupled to the cuff portion such that said subcuff portion is received within and moves independently from said cuff portion when said subcuff portion is generally snug about a wearer's wrist and includes padding to provide protection to the wearer's wrist from blows during playing, wherein the subcuff portion includes a front edge that is free from attachment to the hand portion.

21. The protective sports glove of claim 20, wherein said subcuff portion includes a rear edge spaced rearwardly from said front edge, wherein said subcuff portion is separated from at least one of said hand portion and said cuff portion by a gap located forward of the front edge, wherein the front edge is independently moveable away from and toward the at least one of the cuff portion and the hand portion to open and close the gap, respectively.

22. The protective sports glove of claim 21, wherein said subcuff portion has a first end and a second end, which are releasably engageable through a hook and loop attachment such that said subcuff portion extends entirely around said wearer's wrist.

23. The protective sports glove of claim 20, wherein said cuff portion includes at least one flared section having a forward and a rear end, wherein said forward end is coupled to said opposing back portion and said rear end is flared outwardly with respect to the back of a wearer's hand.

24. The protective sports glove of claim 23, wherein said entire cuff portion flares outwardly away from said wearer's hand along its outer length away from said hand portion.

25. The protective sports glove of claim 23, wherein said at least one flared section has a radius of curvature from a first side to a second side such that as a wearer's wrist flexes toward said at least one flared section it receives on wearer's forearm.

26. The protective sports glove of claim 20 wherein said subcuff portion is connected to an inner surface of the cuff portion.

27. The protective sports glove of claim 20 wherein the subcuff portion includes an outer surface and opposing portions configured to be positioned on opposing sides of at least one of the wearer's wrist and forearm, wherein the cuff portion includes an inner surface facing the subcuff portion, wherein a first elastic member is joined between one of the opposing portions and the inner surface of the cuff portion, wherein a second elastic member is positioned between another of the opposing portions and the inner surface of the cuff portion.

28. The protective sports glove of claim 20 wherein the subcuff portion includes a middle region including padding to protect the wearer's wrist, and a pair of end portions that are joined with one another.

29. The protective sports glove of claim 20 wherein the subcuff portion includes a middle region including the padding, and a first end and a second end, wherein the first end is joined to an interior surface of the cuff portion with an elastic member.

30. A protective sports glove, comprising:

a hand portion having a palm portion and an opposing back portion with a plurality of protective padded portions joined therewith;

a cuff portion joined with said hand portion, said cuff portion overlying at least a portion of a wearer's wrist and/or forearm;

a plurality of finger portions extending from said hand portions for receipt of a wearer's fingers;

a thumb portion joined with said hand portion for receipt of a wearer's thumb;

said cuff portion having a first section having a forward end joined with said hand portion and a rear end; and a subcuff portion supported radially inwardly from said cuff portion, said subcuff portion joined with the glove and adapted to float for independent movement of the subcuff portion relative to said cuff portion, wherein the subcuff portion is configured to move toward and away from the hand portion in response to the flexure of the player's wrist in play, wherein the subcuff portion includes a front edge and a rear edge spaced rearwardly from the front edge, wherein the front edge is free from attachment to at least one of said hand portion and the cuff portion, along at least a portion of said front edge, so as to form a gap between the front edge and at least one of the hand portion and the cuff portion, wherein the gap widens and narrows as the player's wrist flexes in play.

31. The protective sports glove of claim 30, wherein said subcuff portion is elastically coupled to said cuff portion such that said subcuff portion moves in conjunction with a wearer's hand to provide protection to the underside of a wearer's wrist during play.

32. The protective sports glove of claim 30, wherein said subcuff portion extends substantially around the circumference of a wearer's wrist, and wherein the front edge and the rear edge are generally parallel to one another around the circumference of the wearer's wrist.

33. The protective sports glove of claim 30, wherein said subcuff portion has a first end and a second end, which are releasably engageable with one another such that said subcuff extends entirely around said wearer's wrist.

34. The protective sports glove of claim 33 wherein said compliant material is attached to said subcuff portion in spaced relation from said first and second ends.

35. The protective sports glove of claim 30, wherein said cuff portion includes a second section spaced from the first section, the second section being joined with the hand portion, the first section and the second section disposed on opposing sides of at least one of a player's wrist and forearm, wherein the first section and the second section of the cuff portion are joined with a securing device extending between the first section and the second section of the cuff portion, the securing device adapted to bring the first and section sections closer to one another.

36. The protective sports glove of claim 30 wherein the subcuff portion includes an outer surface and opposing portions configured to be positioned on opposing sides of at least one of the wearer's wrist and forearm, wherein the cuff portion includes an inner surface facing the subcuff portion, wherein a first elastic member is joined between one of the opposing portions and the inner surface of the cuff portion, wherein a second elastic member is positioned between another of the opposing portions and the inner surface of the cuff portion.

37. The protective sports glove of claim 30 wherein the subcuff portion includes a middle region including padding to protect the wearer's wrist, and a pair of end portions that are joined with one another.

38. The protective sports glove of claim 30 wherein the subcuff portion includes a middle region including padding, and a first end and a second end, wherein the first end is joined to an interior surface of the cuff portion with an elastic member.

39. A protective sports glove, comprising:

a cuff portion for overlying a portion of a wearer's forearm;

a hand portion coupled to said cuff portion, said hand portion having a palm portion and an opposing back portion with a plurality of protective padded portions secured thereon;

a plurality of finger portions secured to and extending from said hand portion for receipt of a wearer's fingers therein;

a thumb portion secured to and extending from said hand portion; and a subcuff portion that is coupled to the cuff portion such that said subcuff portion is received within and moves independently from said cuff portion when said subcuff portion is generally snug about a wearer's wrist, the subcuff portion including padding to provide protection to the wearer's wrist from blows during playing, wherein the subcuff portion includes a front edge that is free from attachment to the cuff portion.

40. The protective sports glove of claim 39 wherein said subcuff portion includes a rear edge spaced rearwardly from said front edge, wherein said subcuff portion is separated from at least one of said hand portion and said cuff portion by a gap located adjacent and forward of the front edge, wherein the front edge is movable away from and toward the at least one of the cuff portion and the hand portion to open and close the gap, respectively.

* * * * *

UNITED STATES PATENT AND TRADEMARK OFFICE

CERTIFICATE OF CORRECTION

PATENT NO. : 7,636,951 B2
APPLICATION NO. : 10/904445
DATED : December 29, 2009
INVENTOR(S) : Morrow et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 675 days.

Signed and Sealed this

Ninth Day of November, 2010

David J. Kappos

David J. Kappos
*Director of the United States Patent and Trademark Office*